US009522552B2

(12) United States Patent
Ishida et al.

(10) Patent No.: US 9,522,552 B2
(45) Date of Patent: Dec. 20, 2016

(54) CUTTER AND PRINTER

(71) Applicant: Seiko Epson Corporation, Tokyo (JP)

(72) Inventors: Tetsugo Ishida, Yamagata-mura (JP); Hideaki Nishijima, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/968,082

(22) Filed: Dec. 14, 2015

(65) Prior Publication Data

US 2016/0185139 A1 Jun. 30, 2016

(30) Foreign Application Priority Data

Dec. 25, 2014 (JP) ..... 2014-261881

(51) Int. Cl.

| | |
|---|---|
| ***B41J 11/70*** | (2006.01) |
| ***B26D 1/06*** | (2006.01) |
| ***B26D 5/08*** | (2006.01) |
| ***B26D 1/16*** | (2006.01) |
| *B41J 11/66* | (2006.01) |
| *B26D 1/15* | (2006.01) |

(52) U.S. Cl.

CPC ..... *B41J 11/70* (2013.01); *B26D 1/065* (2013.01); *B26D 1/16* (2013.01); *B26D 5/08* (2013.01); *B26D 5/083* (2013.01); *B41J 11/706* (2013.01); *B26D 1/151* (2013.01); *B41J 11/66* (2013.01); *B41J 11/663* (2013.01)

(58) Field of Classification Search

CPC ..... B41J 11/70; B41J 11/703; B41J 11/706; B41J 11/66; B41J 11/663; B26D 1/15; B26D 1/151; B26D 1/01; B26D 1/16; B26D 1/165; B26D 1/065; B26D 1/00; B26D 5/083; B26D 5/08

See application file for complete search history.

(56) References Cited

U.S. PATENT DOCUMENTS 5,344,091 A * 9/1994 Molison ..... B26D 1/385 242/527.1
8,596,894 B2 * 12/2013 Hanaoka ..... B26D 1/305 400/621

FOREIGN PATENT DOCUMENTS

JP 5-318385 A 12/1993

* cited by examiner

*Primary Examiner* — Henok Legesse

(57) ABSTRACT

A cutter has a first cutter blade moving mechanism 24 that moves a first cutter blade 21 reciprocally between a forward position 21A where recording paper 3 is cut and a retracted position 21B separated from the forward position 21A; and a second cutter blade moving mechanism 25 that moves a second-cutter blade 22 between a contact position 22A where the paper is cut in contact with the first-cutter blade 21 and a release position 22B separated from the contact position. The second cutter blade moving mechanism 25 sets the second cutter blade 22 to the release position 22B before the first cutter blade moving mechanism 24 moves the first cutter blade 21 from the forward position 21A to the retracted position 21B. Wear and noise can be prevented because the two cutter blades 21, 22 do not contact after cutting the recording paper 3.

12 Claims, 8 Drawing Sheets

CUTTER AND PRINTER

BACKGROUND

1. Technical Field

The present invention relates to a cutter for cutting sheet media by moving a first cutter blade and a second cutter blade against each other, and to a printer having the cutter.

2. Related Art

JP-A-H5-318385 describes a cutter of the related art. In JP-A-H5-318385, a first cutter blade moves reciprocally between a forward position where the medium is cut, and a retracted position removed from the forward position. The second cutter blade is disposed to a cutting position where the first cutter blade slides against the second cutter blade on the outbound path of the first cutter blade as it moves from the retracted position to the forward position. The second cutter blade is also disposed to a separation position where the second cutter blade separates from the first cutter blade on the return path of the first cutter blade returning from the forward position to the retracted position. Because the contact period of the first cutter blade and the second cutter blade is shorter in the cutter described in JP-A-H5-318385 than in a cutter in which the first cutter blade is in contact with the second cutter blade while moving reciprocally between the forward position and the retracted position, wear and noise from the two cutter blades sliding together can be suppressed.

Contact between the second cutter blade and the first cutter blade is eliminated with the cutter described in JP-A-H5-318385 on the return path of the first cutter blade returning from the forward position to the retracted position. Therefore, if the timing when contact between the first cutter blade and the second cutter blade is eliminated is not set appropriately, the space in which there is no contact between the cutter blades on the return path becomes shorter. If the space of no contact between the cutter blades on the return path is too short, there is still wear and chatter from the blades rubbing against each other after the medium is cut.

SUMMARY

A cutter and a printer having the cutter of the invention prevent wear and chatter between the two cutter blades after cutting the medium.

A cutter according to a preferred aspect of the invention has: a first cutter blade; a second cutter blade that cuts sheet media in conjunction with the first cutter blade; a first cutter blade moving mechanism that reciprocally moves the first cutter blade between a forward position where the media is cut and a retracted position separated from the forward position; and a second cutter blade moving mechanism that moves the second cutter blade between a contact position in contact with the first cutter blade where the media is cut, and a release position separated from the contact position. The second cutter blade moving mechanism moves the second cutter blade to the release position before the first cutter blade moving mechanism moves the first cutter blade from the forward position to the retracted position.

After cutting the media, the second cutter blade moving mechanism moves the second cutter blade from the contact position to the release position before the first cutter blade moves from the forward position to the retracted position. Contact between the first cutter blade and second cutter blade is thus eliminated throughout the entire range of movement of the first cutter blade from the forward position to the retracted position. Wear and noise from the two cutter blades after cutting the media can therefore be prevented.

In a cutter according to another aspect of the invention, the second cutter blade moving mechanism preferably moves the second cutter blade to the contact position before the first cutter blade moving mechanism moves the first cutter blade from the retracted position to the forward position.

Thus comprised, the second cutter blade can contact the first cutter blade while the first cutter blade moves from the retracted position to the forward position. If the second cutter blade is at the contact position on the outbound path of the first cutter blade from the retracted position to the forward position, the length between the retracted position and the forward position on the outbound path must be increased to assure a sufficient cutting period once the first cutter blade and the second cutter blade make contact. However, if the second cutter blade moving mechanism sets the second cutter blade to the contact position before the first cutter blade moves from the retracted position, the length of the outbound path of the first cutter blade does not need to be increased. Increasing device size can therefore be avoided.

Furthermore, if the second cutter blade is set to the contact position on the outbound path of the first cutter blade from the retracted position to the forward position, and the timing when the second cutter blade is set to the contact position is off, the cutting period will be shortened and the media may not be desirably cut. However, if the second cutter blade moving mechanism sets the second cutter blade to the contact position before the first cutter blade moves from the retracted position to the forward position, the length of the cutting period can be kept constant, and the media can be desirably cut.

Further preferably in a cutter according to another aspect of the invention, the second cutter blade moving mechanism includes a support member that supports the second cutter blade rockably on a predetermined axis of rotation, a cam that rotates in conjunction with movement of the first cutter blade, and an urging member that urges the cam and the support member to contact. The support member moves the second cutter blade from the contact position to the release position by rotation of the cam urged in contact with the support member by the urging member moving the support member.

Thus comprised, the second cutter blade can be moved in conjunction with movement of the first cutter blade.

Preferably, the second cutter blade moving mechanism has a support member that supports the second cutter blade rockably on a predetermined axis of rotation, a cam that turns in conjunction with movement of the first cutter blade, and an urging means that urges the cam and the support member in contact; and the support member moves the second cutter blade from the release position to the contact position by rotation of the cam urged in contact with the support member by the urging means moving the support member.

Another aspect of the invention is a printer having the cutter of the invention; a printhead; and a conveyance mechanism that conveys sheet media through a conveyance path passing the printing position of the printhead and the cutting position of the cutter.

Thus comprised, wear of the two cutter blades of the cutter mechanism can be suppressed. Cutter life can therefore be increased and the service life of the printer can be increased. Noise from the two cutter blades of the cutter sliding against each other can also be suppressed. Noise from the printer can therefore be suppressed.

Other objects and attainments together with a fuller understanding of the invention will become apparent and appreciated by referring to the following description and claims taken in conjunction with the accompanying drawings.

DESCRIPTION OF EMBODIMENTS

A preferred embodiment of a printer according to the present invention is described below with reference to the accompanying figures.

General Configuration

Figure 1:
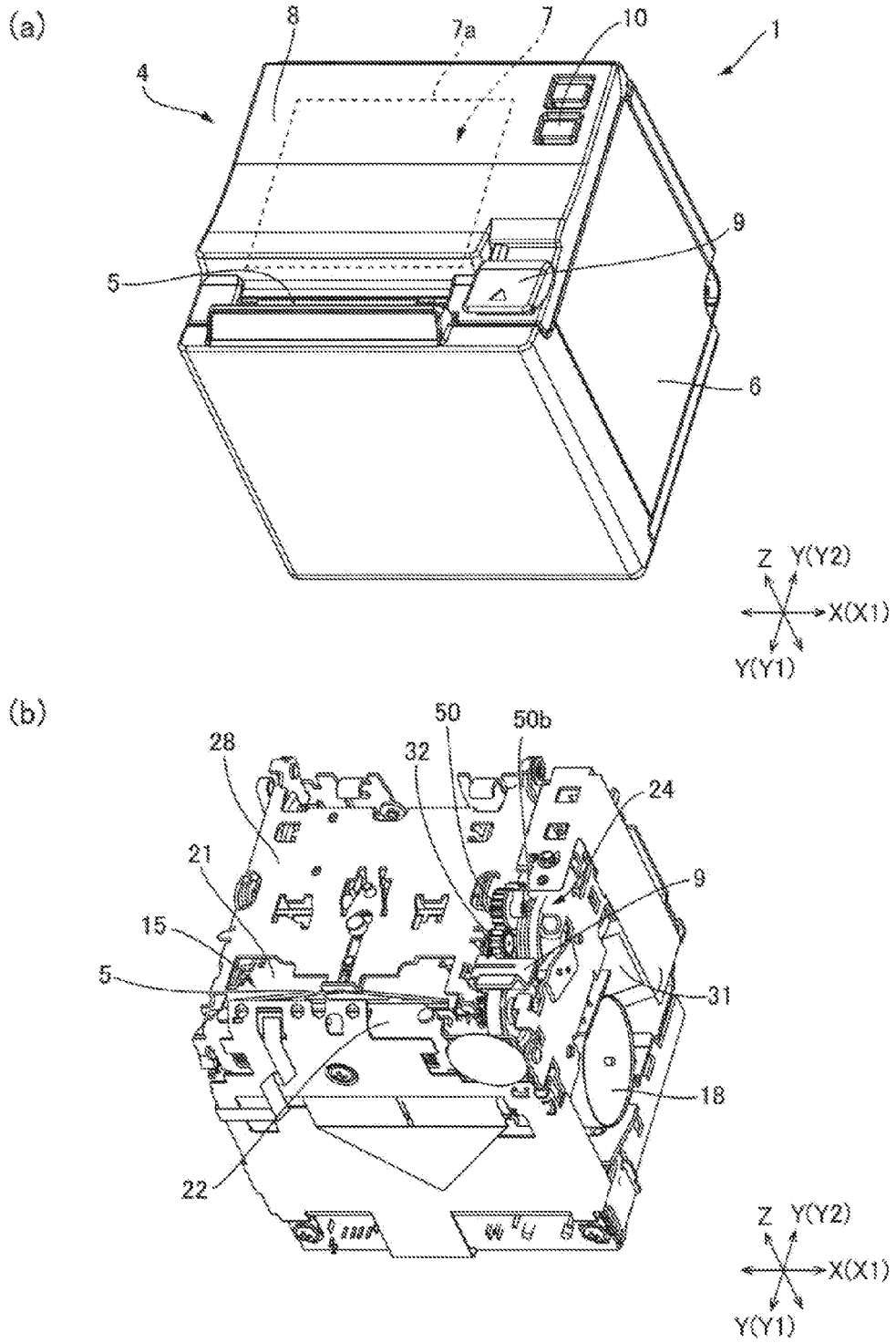
FIG. 1 is an oblique view of a printer according to the invention.
Figure 2:
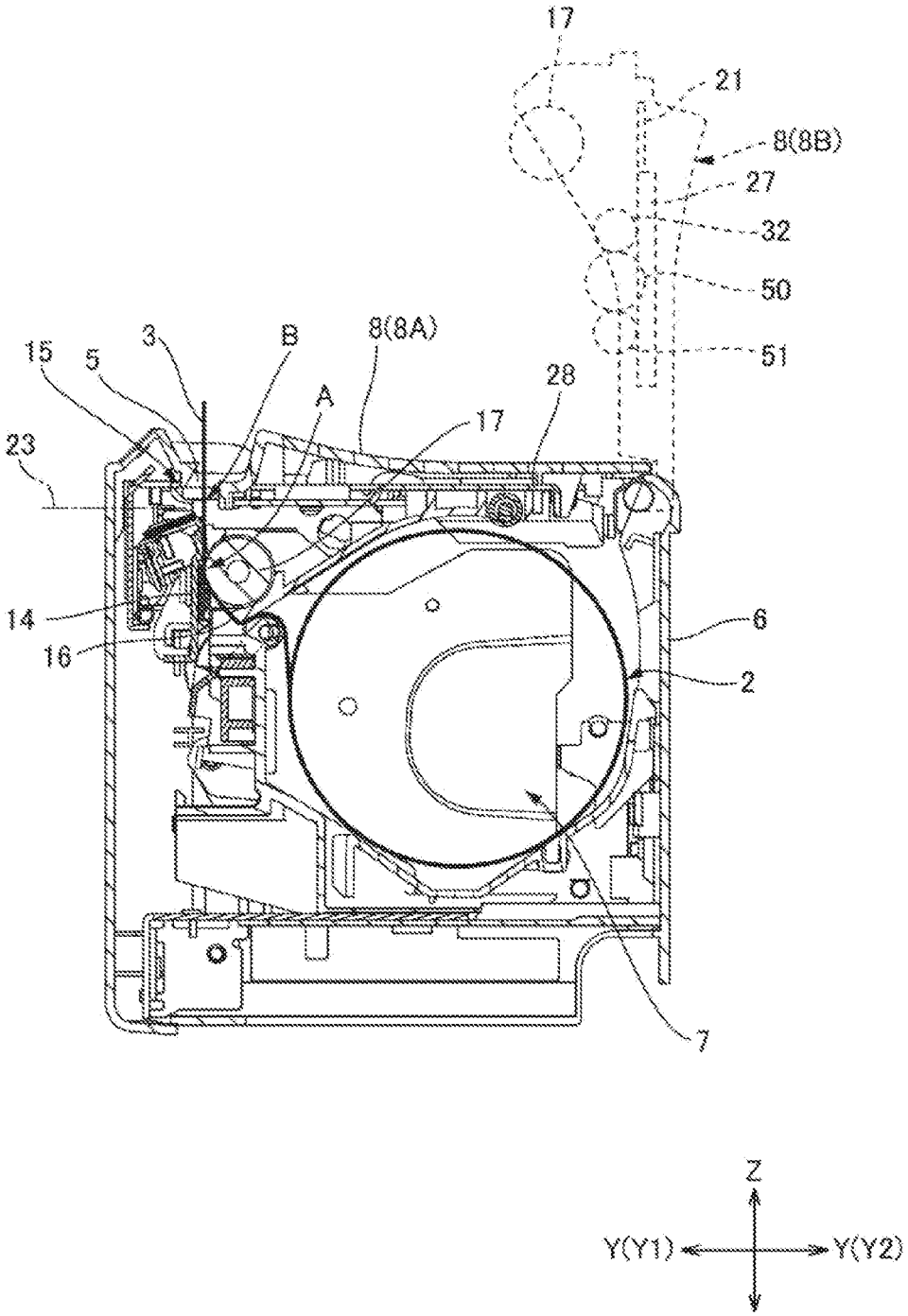
FIG. 2 is a schematic section view of the printer in FIG. 1.

FIG. 1, view (a) is an oblique view of a printer 1 according to an embodiment of the invention, and FIG. 1, view (b) is an oblique view of the printer 1 in view (a) without the outside case 4. FIG. 2 is a section view of the printer 1 in FIG. 1. The printer 1 in this example is a roll paper printer that prints on recording paper 3 delivered from a paper roll 2. As shown in FIG. 1, the printer 1 has a basically box-like printer case 4. A paper exit 5 from which the recording paper 3 is discharged is formed in the top front part of the printer case 4. The paper exit 5 extends widthwise to the printer 1. Note that three mutually perpendicular axes, a transverse axis X aligned with the printer width, a longitudinal axis Y, and a vertical axis Z, are used below.

The printer case 4 includes a box-like main case 6, and an access cover 8 that opens and closes the top of the main case 6. The main case 6 has a roll paper compartment 7 inside (see FIG. 2), and the cover 8 covers a roll paper loading opening 7*a* from above (above on the vertical axis Z).

The cover 8 is attached toward the back, Y2, of printer 1 (Y2 identifies a direction toward the rear of printer 1 along the longitudinal axis Y) behind the paper exit 5. A release button 9 is disposed beside the cover 8 on one side, and preferably on a side toward a direction X1, where X1 identifies a right-ward direction along the transverse axis X when facing the front of printer 1 in FIG. 1. A power switch 10 is disposed behind the release button 9 toward the back, Y2. Operating the release button 9 unlocks the cover 8. When unlocked, the cover 8 can pivot on a spindle extending along the transverse axis X. The cover 8 moves between a closed position 8A (see FIG. 2) where the cover 8 is horizontal and closes the roll paper compartment 7, as shown in FIG. 1, and an open position 8B where the cover 8 is upright and the roll paper compartment 7 is open as indicated by the dotted line in FIG. 2.

As shown in FIG. 2, inside the printer case 4 are a printhead 14 and a cutter 15. Also inside the printer case 4 is the conveyance path 16 through which the recording paper 3 travels from the roll paper compartment 7, past the printing position A of the printhead 14, past the cutting position B of the cutter 15, and to the paper exit 5.

The printhead 14 is preferably a thermal head. The printing position A is defined by a platen roller 17 opposite the printhead 14. Torque from a conveyance motor 18 is transferred to the platen roller 17. The platen roller 17 and conveyance motor 18 (see view (b) in FIG. 1) embody the conveyance mechanism that conveys the recording paper 3 through the conveyance path 16.

The printer 1 drives the conveyance motor 18 to turn the platen roller 17 and convey the recording paper 3 set in the conveyance path 16 at a specific speed. The printer 1 also drives the printhead 14 to print on the recording paper 3 as it travels past the printing position A. the printer 1 also drives the cutter 15 to cut the recorded part of the recording paper 3 after printing is completed.

Cutter

Figure 3:
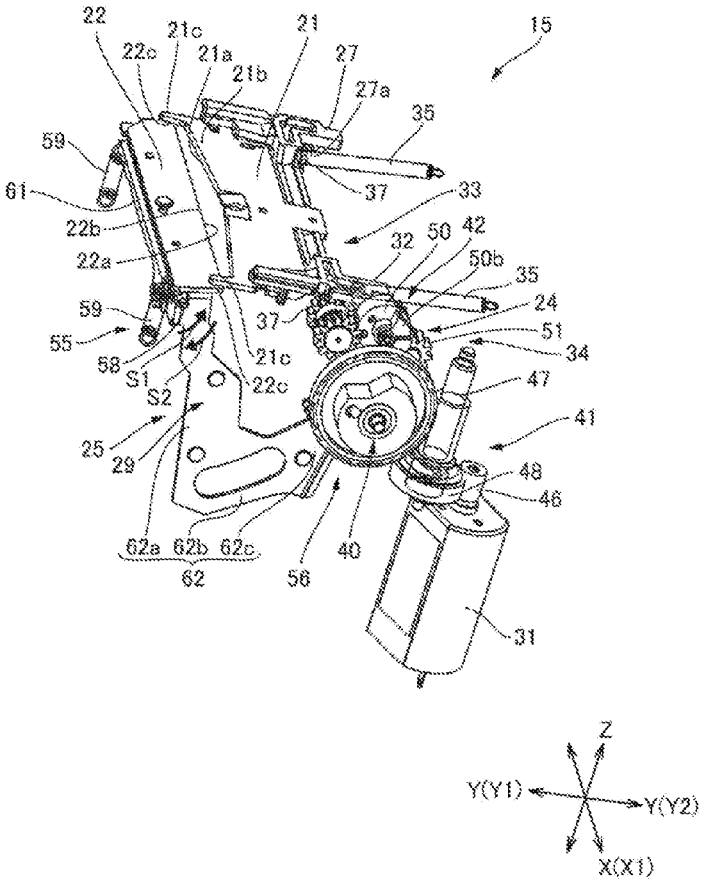
FIG. 3 is an oblique view of the cutter.
Figure 4:
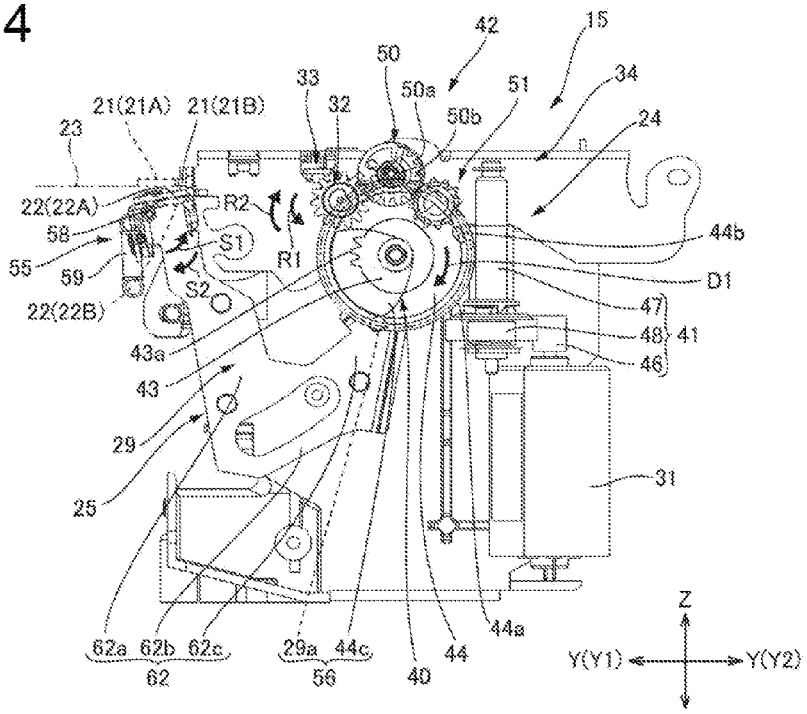
FIG. 4 is a side view of the cutter.

FIG. 3 is an oblique view of the cutter 15. FIG. 4 is a side view of the cutter 15. Note that the intermittent teeth of the compound gear, the compound gear-side protrusion and cam, and the cutter blade return protrusion of the cutter blade return gear are shown in FIG. 4 for easier understanding. As shown in FIG. 1, view (b) and FIG. 3, the cutter 15 has a first cutter blade 21 and a second cutter blade 22. The second cutter blade cuts the recording paper 3 in conjunction with the first cutter blade 21. The cutter 15 also has a first cutter blade moving mechanism 24 that moves the first cutter blade 21 along a predetermined plane of motion 23 (see FIG. 2 and FIG. 4). The plane of motion 23 is a plane that intersects the conveyance path 16 at the cutting position B below the paper exit 5 and is perpendicular to the vertical axis Z. As shown in FIG. 4, the first cutter blade moving mechanism 24 moves the first cutter blade 21 reciprocally between the forward position 21A where the recording paper 3 is cut, and a retracted position 21B separated from the forward position 21A.

The cutter 15 also has a second cutter blade moving mechanism 25 that causes the second cutter blade 22 to rock between a contact position 22A where the second cutter blade 22 slides against the first cutter blade 21 to cut the recording paper 3, and a release position 22B where the second cutter blade 22 is separated from the first cutter blade 21 (and separated from plane of motion 23).

The cutter 15 cuts the recording paper 3 on the conveyance path 16 at the cutting position B by moving the first cutter blade 21 from the retracted position 21B to the forward position 21A when the second cutter blade 22 is at the contact position 22A.

First Cutter Blade and Second Cutter Blade

As shown in FIG. 3, the cutting edge 21*a* of the first cutter blade 21 faces the front direction, Y1 (the front direction Y1 along the longitudinal axis Y). The first cutter blade 21 is a flat blade with a plane shape that is left-right symmetrical (e.g. symmetrical about a bisecting line, preferably along the Y axis). The front edge of the first cutter blade 21 forms a V-shaped knife edge 21*b* that recedes toward the back direction Y2 at its center as determined on the transverse axis X. The first cutter blade 21 also has a pair of lift guides 21*c* that protrude to the front Y1 on opposite ends of the knife edge 21*b* on the transverse axis X. The lift guides 21*c* extend to a position resting on matching ends (seat parts 22*c*) of the second cutter blade 22 when seen from above along the vertical axis Z. The back end of the first cutter blade 21 is supported by a rack member 27. The cutter 15 blades and rack member 27 are supported by a cover side frame 28 (FIG. 1, view (b)), which can move on the longitudinal axis Y.

The cutting edge 22*a* of the second cutter blade 22 faces the cutting edge 22*a*. The second cutter blade 22 is a flat, rectangular blade that is long on the transverse axis X. The second cutter blade 22 has seat parts 22*c* on the back (the side facing the first cutter blade 21) at opposite ends on the transverse axis X. The lift guides 21*c* of the first cutter blade 21 slide in contact with the tops of the seat parts 22*c*. The knife edge 22*b* of the second cutter blade 22 extends in a straight line on the transverse axis X between the lift guides 21*c*. The second cutter blade 22 is carried by a support frame 29.

First Cutter Blade Moving Mechanism

As shown in FIG. 3, the first cutter blade moving mechanism 24 includes a drive motor 31 as the drive source, a drive gear 32, a rotary to linear conversion mechanism 33 for converting rotation of the drive gear 32 to linear motion and moving the first cutter blade 21 reciprocally on the plane of motion 23, and a transfer mechanism 34 for transferring rotation of the drive motor 31 to the drive gear 32. The first cutter blade moving mechanism 24 also has an urging member that urges the first cutter blade 21 from the forward position 21A side to the retracted position 21B. The urging member in this example is a coil spring 35.

The rotary to linear conversion mechanism 33 in this example is a rack and pinion mechanism. More specifically, the rotary to linear conversion mechanism 33 has a pinion disposed coaxially to and rotating in unison with the drive gear 32, and a rack 27*a* disposed to the rack member 27 that supports the first cutter blade 21. The pinion 37 meshes with the rack 27*a*. The drive motor 31 is a DC motor, and is driven rotationally in one direction. In this example, the rotary to linear conversion mechanism 33 moves the first cutter blade 21 from the retracted position 21B to the forward position 21A by turning the drive gear 32 a specific angle of rotation in a first direction of rotation R1 (see FIG. 4). The rotary to linear conversion mechanism 33 also moves the first cutter blade 21 from the forward position 21A to the retracted position 21B by the drive gear 32 turning a specific angle of rotation in a second direction of rotation R2 that is opposite the first direction of rotation R1.

The transfer mechanism 34 includes a compound gear (intermittent gear) 40, an upstream transfer mechanism 41, and a downstream transfer mechanism 42. The upstream transfer mechanism 41 is positioned on the upstream side of the compound gear 40 on the transfer path of rotation from the drive motor 31, and the downstream transfer mechanism 42 is on the downstream side of the compound gear 40. The first cutter blade 21 travels round trip to the forward position 21A and retracted position 21B while the compound gear 40 is turned one revolution by driving the drive motor 31.

The compound gear 40 is supported on a rotary shaft extending along the transverse axis X below the plane of motion 23 of the first cutter blade 21. As shown in FIG. 4, the compound gear 40 has an intermittent gear part 43 and a large diameter gear part 44. The intermittent gear part 43 has intermittent teeth (toothed part) 43*a* formed through a specific angular range. The large diameter gear part 44 is larger in diameter than the intermittent gear part 43, and is formed coaxially to the intermittent gear part 43. The large diameter gear part 44 is located on the one side X1 (outside side) of the intermittent gear part 43 on the transverse axis X.

The large diameter gear part 44 has teeth (toothed part) 44*a* around the full outside circumference. The large diameter gear part 44 also has a compound gear-side protrusion (contact part) 44*b* that protrudes from the face on the intermittent gear part 43 side on the transverse axis X toward the intermittent gear part 43. The compound gear-side protrusion 44*b* is disposed closer to the outside circumference than the intermittent teeth part 43*a* of the intermittent gear part 43 and at a different angular position than the intermittent teeth part 43*a*. The compound gear-side protrusion 44*b* extends circumferentially through a specific angular range.

The compound gear 40 also has a cam 44*c*. The cam 44*c* is formed in unison with the intermittent teeth part 43*a* and large diameter gear part 44. The cam 44*c* and the compound gear-side protrusion 44*b* of the large diameter gear part 44 are also disposed to different angular positions.

The upstream transfer mechanism 41 has a pinion 46 disposed on the output shaft of the drive motor 31, a worm 47 to which rotation of the pinion 46 is transferred, and a clutch mechanism 48 between the worm 47 and the pinion 46.

The drive motor 31 is disposed with the output shaft on the vertical axis Z. The rotary shaft of the worm 47 is also on the vertical axis Z. The worm 47 meshes with the toothed part 44*a* of the large diameter gear part 44 in the compound gear 40. The clutch mechanism 48 disengages the worm 47 and the pinion 46 when, for example, great torque is input from the downstream side to the upstream side of the transfer path. The clutch mechanism 48 thus prevents damage to the first cutter blade moving mechanism 24.

The downstream transfer mechanism 42 includes a cutter blade return gear 50 that meshes with the drive gear 32, and a transfer gear 51 that transfers rotation of the compound gear 40 to the cutter blade return gear 50. The drive gear 32, cutter blade return gear 50, and transfer gear 51 are located above the intermittent gear part 43 of the compound gear 40. The drive gear 32, cutter blade return gear 50, and transfer gear 51 are also arranged in this order from the front Y1 to the back Y2. The rotary shaft of the drive gear 32 is located in front Y1 of the compound gear 40 shaft, and the rotary shaft of the transfer gear 51 is located in back Y2 of the compound gear 40 shaft.

The transfer gear 51 can mesh with the intermittent teeth part 43*a* of the compound gear 40 (intermittent gear part 43). The cutter blade return gear 50 is an intermittent gear. The intermittent teeth part 50*a* of the cutter blade return gear 50 meshes with both the drive gear 32 and the transfer gear 51. Note that the cutter blade return gear 50 is a common gear with teeth around its full circumference.

The cutter blade return gear 50 also has a cutter blade return protrusion 50*b* at a position offset radially from its axis of rotation. The cutter blade return protrusion 50*b* is fan-shaped and spreads circumferentially to the outside. The pivot point of the fan shape matches the axis of rotation of the cutter blade return gear 50.

The cutter blade return protrusion 50*b* can contact the compound gear-side protrusion 44*b* of the compound gear 40. More specifically, the circular path the cutter blade return protrusion 50*b* turns when the cutter blade return gear 50 turns one revolution, and the circular path of the compound gear-side protrusion 44*b* of the compound gear 40 when the compound gear 40 turns one revolution, overlap in part. As a result, when the compound gear 40 turns one revolution, the compound gear-side protrusion 44*b* of the compound gear 40 contacts the cutter blade return gear 50 for a specific period only, and moves the cutter blade return protrusion

50*b* in the direction of rotation D1 of the compound gear 40. The period when the compound gear-side protrusion 44*b* of the compound gear 40 and the cutter blade return protrusion 50*b* touch is when the transfer gear 51 and the intermittent teeth part 43*a* of the compound gear 40 are not engaged, and the compound gear-side protrusion 44*b* of the compound gear 40 and the cutter blade return protrusion 50*b* do not touch when the transfer gear 51 and the intermittent teeth part 43*a* of the compound gear 40 are meshed.

Rotation of the compound gear 40 is transferred from the transfer gear 51 through the cutter blade return gear 50 to the drive gear 32 while the compound gear 40 to which rotation of the drive motor 31 is transferred turns one revolution and the intermittent teeth part 43*a* of the compound gear 40 and the transfer gear 51 are meshed. As a result, the drive gear 32 turns a specific angle of rotation in the first direction of rotation R1. The first cutter blade 21 therefore moves from the retracted position 21B to the forward position 21A.

While the compound gear 40 to which rotation of the drive motor 31 is transferred turns one revolution, the intermittent teeth part 43*a* of the compound gear 40 and the transfer gear 51 are disengaged, and the compound gear-side protrusion 44*b* of the compound gear 40 and the cutter blade return protrusion 50*b* of the cutter blade return gear 50 are touching, rotation of the compound gear 40 is transferred through the compound gear-side protrusion 44*b* and the cutter blade return protrusion 50*b* to the cutter blade return gear 50. As a result, the cutter blade return gear 50 turns with the compound gear 40, and the cutter blade return gear 50 turns in the opposite direction as when rotation of the compound gear 40 is transferred through the transfer gear 51. As a result, while the compound gear-side protrusion 44*b* and the cutter blade return protrusion 50*b* are touching, the drive gear 32 turns only a specific angle of rotation in the second direction of rotation R2. The first cutter blade 21 therefore returns from the forward position 21A to the retracted position 21B.

A pair of coil springs 35 extend on the longitudinal axis Y at positions separated on the transverse axis X. The front end of each coil spring 35 is attached to the rack member 27, and the back end is attached to the cover side frame 28. The coil springs 35 stretch and store an urging force when the first cutter blade 21 moves from the retracted position 21B to the forward position 21A. The first cutter blade moving mechanism 24 therefore moves the first cutter blade 21 from the retracted position 21B to the forward position 21A in resistance to the urging force of the coil springs 35. When the first cutter blade moving mechanism 24 moves the first cutter blade 21 from the forward position 21A to the retracted position 21B, movement of the first cutter blade 21 to the retracted position 21B is assisted by the stored urging force of the coil springs 35.

The platen roller 17, the upstream transfer mechanism 41 of the first cutter blade moving mechanism 24 (the transfer gear 51 and cutter blade return gear 50), the drive gear 32, rack member 27, first cutter blade 21, and coil springs 35 are supported by the cover side frame 28. The platen roller 17, upstream transfer mechanism 41, drive gear 32, rack member 27, first cutter blade 21, and coil springs 35 therefore rotate with the cover 8 and separate from the main case 6 when the cover 8 opens.

Second Cutter Blade Moving Mechanism

As shown in FIG. 4, at the contact position 22A where it can contact the first cutter blade 21, the second cutter blade 22 is inclined toward the retracted position 21B of the first cutter blade 21 (toward the back Y2) in the direction approaching the plane of motion 23 of the first cutter blade 21. In this inclined position, the cutting edge 22*a* of the second cutter blade 22 is on the plane of motion 23. By displacing the cutting edge 22*a* from this inclined position downward away from the plane of motion 23, the second cutter blade moving mechanism 25 moves the second cutter blade 22 from the contact position 22A to the release position 22B.

The second cutter blade moving mechanism 25 is assembled below the plane of motion 23 of the first cutter blade 21. As shown in FIG. 3 and FIG. 4, the second cutter blade moving mechanism 25 has a support mechanism 55 and a linkage mechanism 56. The support mechanism 55 supports the second cutter blade 22 rockably around a specific axis of rotation. The linkage mechanism 56 causes the second cutter blade 22 to rock synchronized to movement of the first cutter blade 21 by the first cutter blade moving mechanism 24.

The support mechanism 55 includes the support frame 29 (support member) that carries the second cutter blade 22, a support shaft (rotary shaft) 58 that rockably supports the support frame 29, and urging members 59 that urges the second cutter blade 22 to the contact position 22A by urging the support frame 29. The urging members 59 are coil springs in this example.

As shown in FIG. 3, the support frame 29 includes a cutter support part 61 and a linkage frame part 62. The cutter support part 61 extends on the transverse axis X and supports the second cutter blade 22 from below. The linkage frame part 62 extends down from the one side X1 side ends of the cutter support part 61 on the transverse axis X. The linkage frame part 62 has a front frame part 62*a* that extends down, a middle frame part 62*b* that extends to the back Y2 from the bottom end of the front frame part 62*a*, and a back frame part 62*c* that extends up from the back end part of the middle frame part 62*b*.

A cam follower 29*a* that can contact the cam 44*c* of the compound gear 40 is disposed at the top end of the back frame part 62*c*. The urging members 59 that urge the second cutter blade 22 to the contact position 22A urges the support frame 29 counterclockwise S1 as indicated by the arrow in FIG. 4. The urging members 59 thus urge the cam follower 29*a* in the direction contacting the cam 44*c*.

The support shaft 58 passes through the front top part of the front frame part 62*a* on the transverse axis X. The support shaft 58 is the rotary shaft of the second cutter blade 22, and the axis of the support shaft 58 is the rocking axis (axis of rotation) of the second cutter blade 22. The urging members 59 urge the front top part of the front frame part 62*a* that is located on the opposite side of the support shaft 58 as the cutting edge 21*a* of the second cutter blade 22 down.

The cam follower 29*a* of the support frame 29 and the cam 44*c* of the compound gear 40 embody the linkage mechanism 56. The linkage mechanism 56 moves the second cutter blade 22 between the contact position 22A and release position 22B by moving the support frame 29 with the cam 44*c*, which rotates in conjunction with movement of the first cutter blade 21.

More specifically, while the compound gear 40 turns one revolution and the cam follower 29*a* and cam 44*c* of the compound gear 40 are not touching, if the support frame 29 is urged in the counterclockwise S1 by the urging members 59, the lift guides 21*c* of the second cutter blade 22 contact the lift guides 21*c* of the first cutter blade 21 from below. The second cutter blade 22 is therefore set to the contact position 22A at an angle. When the second cutter blade 22 is in the contact position 22A, the second cutter blade 22 is pushed against the first cutter blade 21 by the urging force of the urging members 59.

When the compound gear 40 turns and the cam follower 29*a* of the support frame 29 and the cam 44*c* of the compound gear 40 contact, the back frame part 62*c* (see FIG. 4) is displaced downward in resistance to the urging force of the urging members 59. As a result, the support frame 29 rotates clockwise S2 as shown by the arrow in FIG. 4 on the support shaft 58. As a result, the cutting edge 21*a* moves down from the plane of motion 23 and the second cutter blade 22 moves to the release position 22B not touching the first cutter blade 21. The second cutter blade 22 remains in the release position 22B while the cam follower 29*a* is in contact with the cam 44*c* of the compound gear 40.

The second cutter blade moving mechanism 25 sets the second cutter blade 22 to the contact position 22A before the first cutter blade moving mechanism 24 moves the first cutter blade 21 from the retracted position 21B to the forward position 21A. The second cutter blade moving mechanism 25 also moves the second cutter blade 22 to the release position 22B before the first cutter blade moving mechanism 24 moves the first cutter blade 21 from the forward position 21A to the retracted position 21B.

Cutting Operation

The operation whereby the cutter 15 cuts the recording paper 3 is described next with reference to FIG. 5 to FIG. 9.

Figure 5:
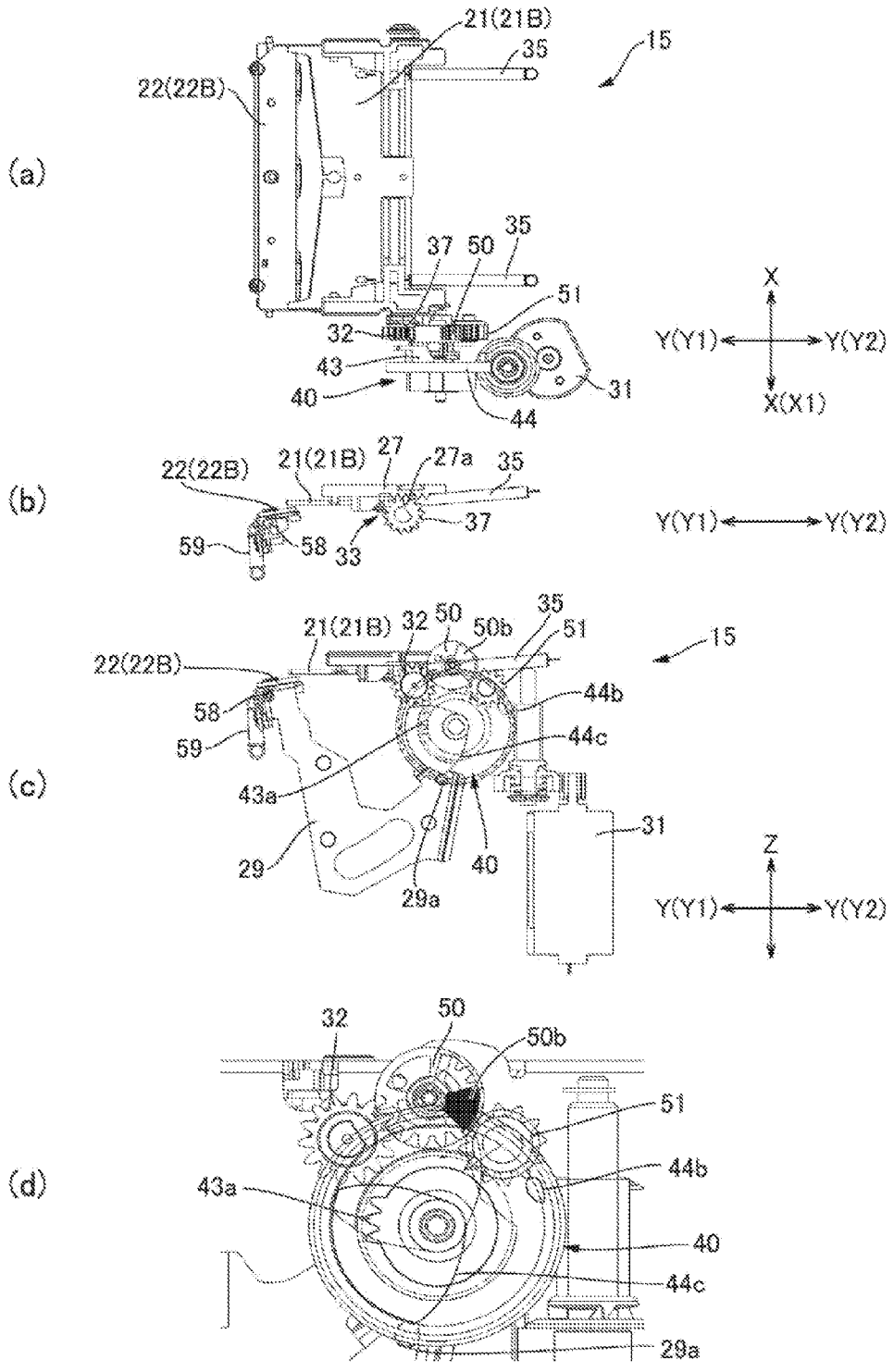
FIG. 5 illustrates the recording paper cutting operation of the cutter.
Figure 6:
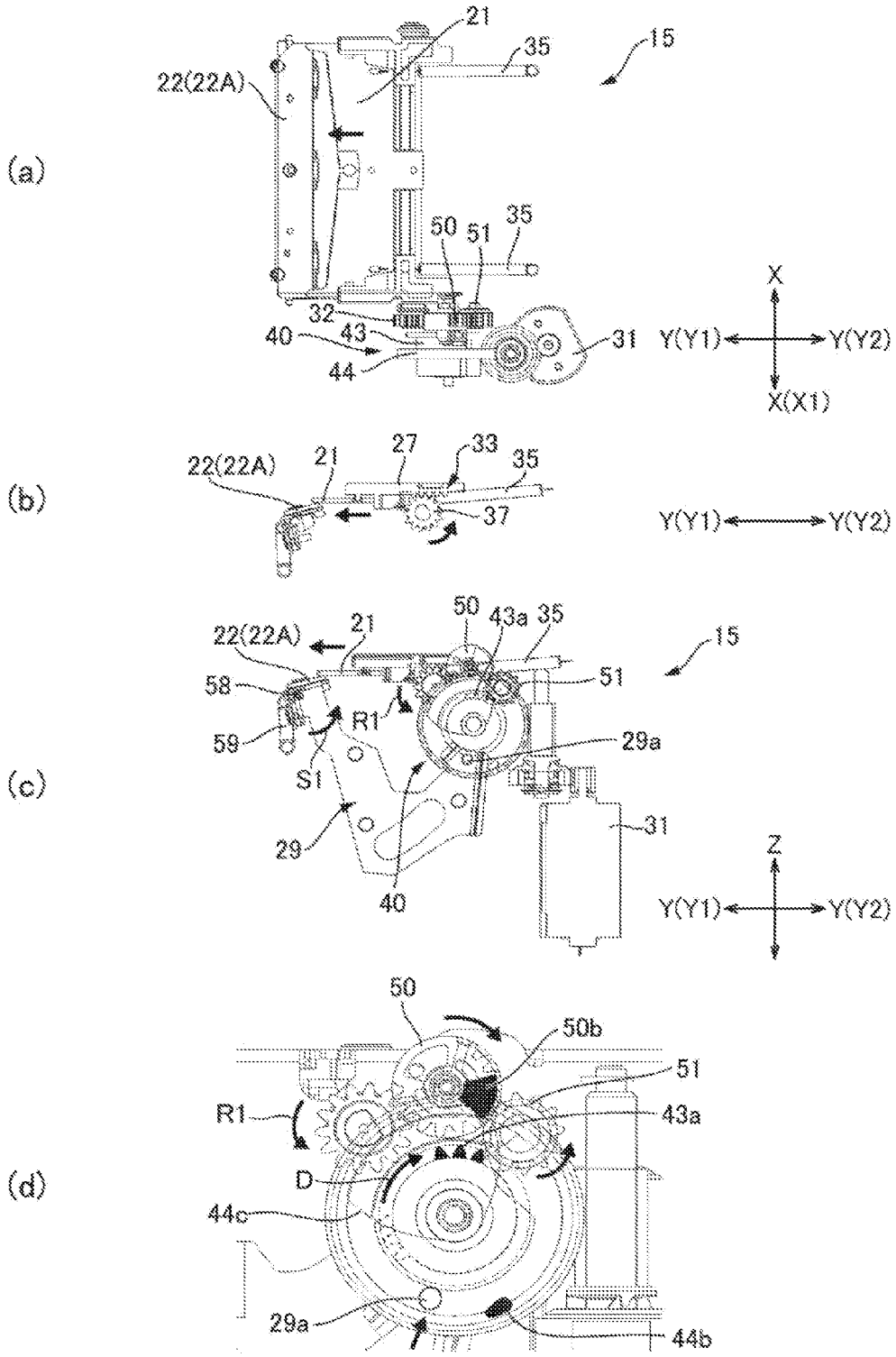
FIG. 6 illustrates the recording paper cutting operation of the cutter.
Figure 7:
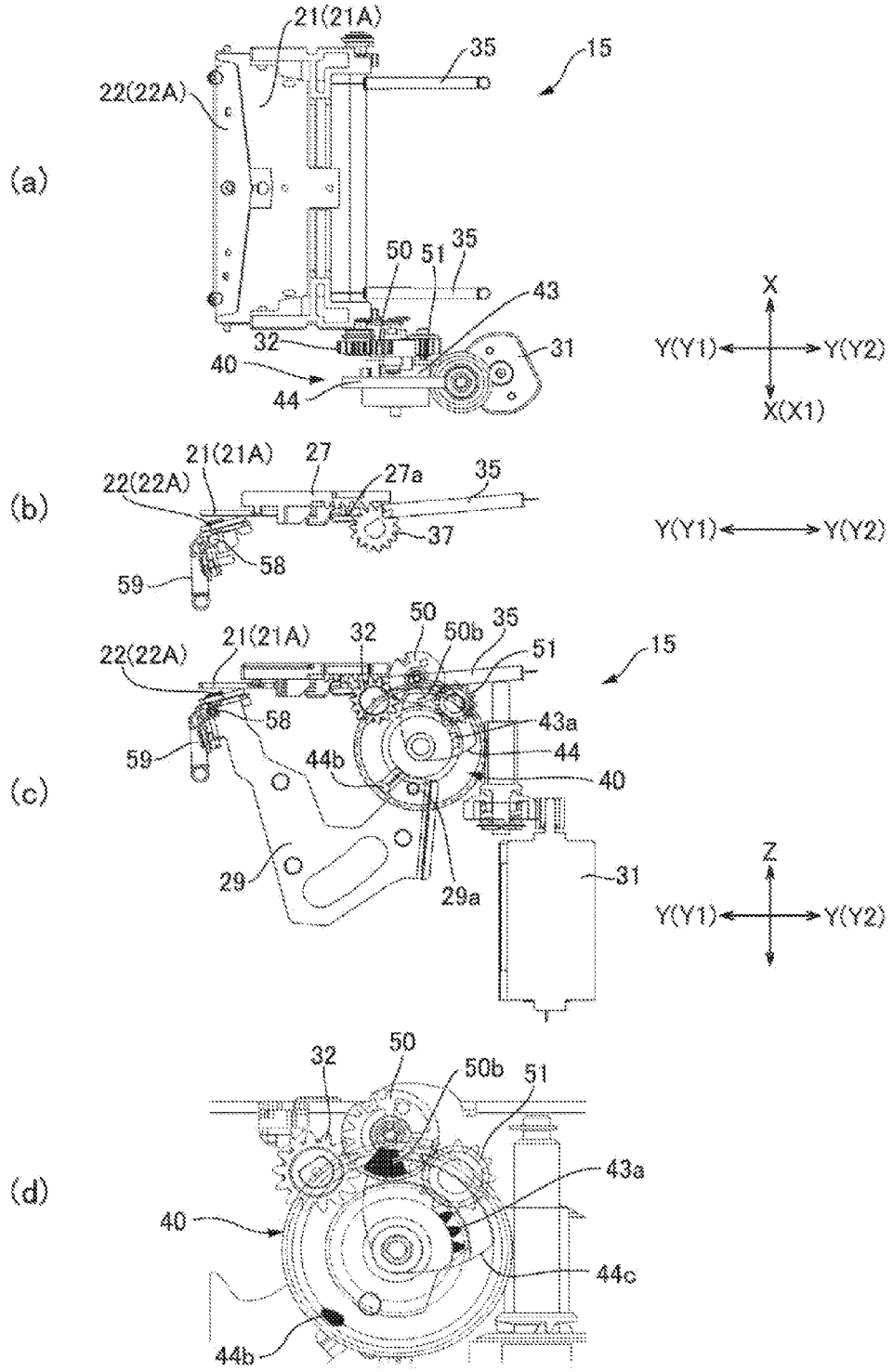
FIG. 7 illustrates the recording paper cutting operation of the cutter.
Figure 8:
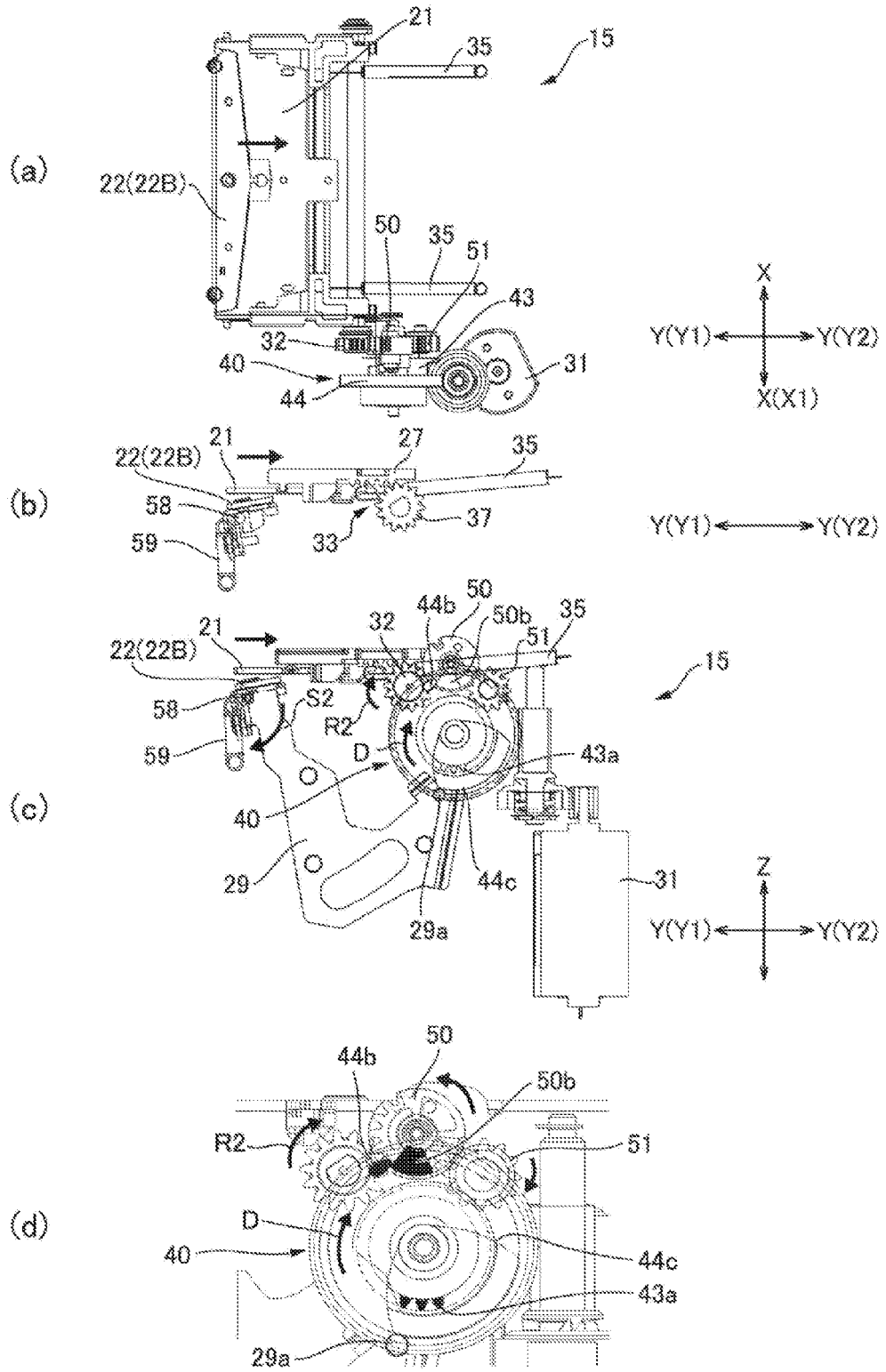
FIG. 8 illustrates the recording paper cutting operation of the cutter.
Figure 9:
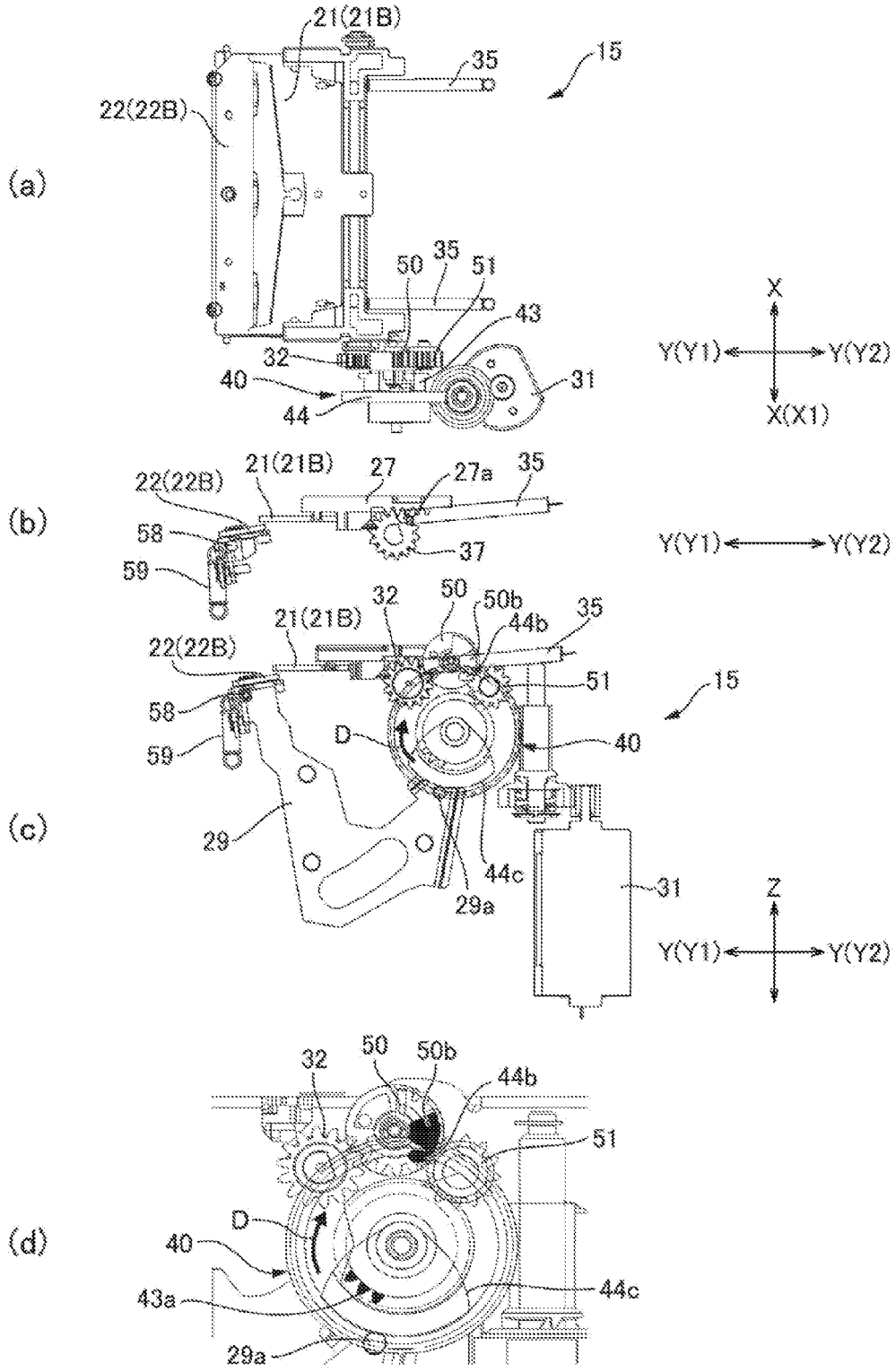
FIG. 9 illustrates the recording paper cutting operation of the cutter.

FIG. 5 shows the cutter 15 in the standby position. FIG. 6 shows immediately before the first cutter blade 21 starts moving. FIG. 7 shows the first cutter blade 21 at the forward position 21A. FIG. 8 shows the cutter 15 immediately after cutting the recording paper 3. FIG. 9 shows the first cutter blade 21 at the retracted position 21B. In each of the figures, view (a) is a plan view of the cutter 15; view (b) is a section view of the cutter 15 through a plane passing through the pinion 37 of the rotary to linear conversion mechanism 33; view (c) is a side view of the cutter 15; and view (d) is an enlarged view of the compound gear 40 and vicinity. In views (c) and (d), the intermittent teeth part 43*a*, compound gear-side protrusion 44*b*, cutter blade return protrusion 50*b*, cam 44*c*, and the cam follower 29*a* are shown to clearly illustrate their positions.

When the printer 1 is off and while the printer 1 is in the standby mode waiting to receive print data, the cutter 15 is in the standby position. In the standby position, as shown in FIG. 5 (*a*), the first cutter blade 21 is in the retracted position 21B. As shown in FIG. 5 (*b*), the pinion 37 coaxial to the drive gear 32 is meshed with the front end part of the rack 27*a* of the rack member 27. As shown in FIGS. 5 (*c*) and (*d*), the intermittent teeth part 43*a* of the compound gear 40 is at an angle separated from the transfer gear 51, and is not meshed with the transfer gear 51. The cutter blade return protrusion 50*b* of the cutter blade return gear 50 is at a position separated from the path of movement of the compound gear-side protrusion 44*b* of the compound gear 40, and the compound gear-side protrusion 44*b* is not touching the cutter blade return protrusion 50*b*. As shown in FIG. 5 (*c*), the cam follower 29*a* of the support frame 29 that supports the second cutter blade 22 is in contact with the cam 44*c* of the compound gear 40. As a result, the back frame part 62*c* (see FIG. 4) of the support frame 29 is pushed down against the urging force of the coil springs 35, and the second cutter blade 22 is at the release position 22B separated from the first cutter blade 21.

When print data is supplied from an external device, the printer 1 drives the conveyance motor 18 to turn the platen roller 17 and convey the paper roll 2 set in the conveyance path 16 at a specific speed. The printer 1 also drives the printhead 14 to print on the recording paper 3 as it passes the printing position A. When printing is completed, the printer 1 drives the drive motor 31 a specific drive time in the same rotational direction. As a result, the cutter 15 operates and cuts the recorded part of the printed recording paper 3.

When the drive motor 31 is driven, the compound gear 40 starts turning in the direction of rotation D1 (clockwise). When the compound gear 40 turns, contact between the cam follower 29*a* of the support frame 29 and the cam 44*c* of the compound gear 40 is immediately released. As a result, the support frame 29 turns counterclockwise S1 on the support shaft 58 due to the urging force of the urging members 59 (FIG. 6 (*c*)). As a result, the second cutter blade 22 moves to the cutting edge 22*a* where it can contact the first cutter blade 21.

As shown in FIG. 6, when the compound gear 40 turns further, the intermittent teeth part 43*a* of the compound gear 40 meshes with the transfer gear 51 a specific time after driving the drive motor 31 starts. In this example, the intermittent teeth part 43*a* meshes with the transfer gear 51 when the intermittent teeth part 43*a* has turns at least 90 degrees on the axis of rotation of the compound gear 40. When the intermittent teeth part 43*a* of the compound gear 40 and the transfer gear 51 mesh, as shown in FIG. 6 (*d*), the transfer gear 51 turns counterclockwise. The cutter blade return gear 50 meshed with the transfer gear 51 also turns clockwise. The drive gear 32 meshed with the cutter blade return gear 50 turns counterclockwise in the first direction of rotation R1. While the intermittent teeth part 43*a* of the compound gear 40 is meshed with the transfer gear 51, the drive gear 32 turns a specific rotational angle in the first direction of rotation R1.

Rotation of the drive gear 32 a specific angle in the first direction of rotation R1 is converted by the rotary to linear conversion mechanism 33 to linear motion of the first cutter blade 21 to the front Y1. The first cutter blade 21 therefore moves a specific distance from the retracted position 21B to the forward position 21A. As a result, the first cutter blade 21 passes the cutting position B on the conveyance path 16 while the knife edge 21*b* is touching the knife edge 22*b* of the second cutter blade 22, and reaches the forward position 21A. The recording paper 3 disposed to the cutting position B is thus cut.

As shown in FIG. 7, when the first cutter blade 21 reaches the forward position 21A, the intermittent teeth part 43*a* of the compound gear 40 and the transfer gear 51 are no longer meshed. As a result, because rotation of the compound gear 40 is not transferred to the drive gear 32, the first cutter blade 21 stops moving at the forward position 21A. When the first cutter blade 21 is at the forward position 21A, the drive gear 32 meshes with the back end part of the rack 27*a* of the rack member 27. Note that while the first cutter blade 21 moves to the forward position 21A, the coil springs 35 stretch and store urging force.

As shown in FIGS. 7 (*c*) and (*d*), the cutter blade return protrusion 50*b* of the cutter blade return gear 50 transferring rotation of the transfer gear 51 to the drive gear 32 is positioned on the path of movement of the compound gear-side protrusion 44*b* of the compound gear 40 while the first cutter blade 21 is moving from the retracted position 21B to the forward position 21A (while the intermittent teeth part 43*a* of the compound gear 40 and the transfer gear 51 are meshed).

As shown in FIG. 8, when the compound gear 40 then turns further, the cam 44*c* of the compound gear 40 and the cam follower 29*a* of the support frame 29 that supports the second cutter blade 22 contact. As a result, as shown in FIG. 8 (*c*), the back frame part 62*c* (see FIG. 4) of the support frame 29 is pushed down, and the support frame 29 rocks clockwise S2 on the support shaft 58 (see FIG. 4). As a result, the second cutter blade 22 moves to the release position 22B separated from the first cutter blade 21.

After the second cutter blade 22 reaches the release position 22B, the compound gear-side protrusion 44*b* of the compound gear 40 contacts the cutter blade return protrusion 50*b* of the cutter blade return gear 50. When the compound gear-side protrusion 44*b* and the cutter blade return protrusion 50*b* contact, engagement between the intermittent teeth part 43*a* of the compound gear 40 and the transfer gear 51 is released. The cutter blade return gear 50 therefore rotates freely and the cutter blade return gear 50 rotates with the compound gear 40 while the compound gear-side protrusion 44*b* and the cutter blade return protrusion 50*b* remain in contact. As a result, the cutter blade return gear 50 rotates counterclockwise as shown in FIG. 8 (*d*), and turns the drive gear 32 clockwise in the second direction of rotation R2. While the compound gear-side protrusion 44*b* and the cutter blade return protrusion 50*b* remain in contact, the drive gear 32 turns a specific angle in the second direction of rotation R2.

Rotation of the drive gear 32 a specific angle in the second direction of rotation R2 is converted by the rotary to linear conversion mechanism 33 to the linear motion of the first cutter blade 21 to the back Y2. The first cutter blade 21 therefore moves a specific distance from the forward position 21A to the retracted position 21B. When the first cutter blade 21 moves to the retracted position 21B, its movement is assisted by the urging force of the coil springs 35.

As shown in FIG. 9, when the compound gear 40 rotates further and the cutter blade return protrusion 50*b* of the cutter blade return gear 50 moves to a position removed from the path of the compound gear-side protrusion 44*b* of the compound gear 40, contact between the compound gear-side protrusion 44*b* and the cutter blade return protrusion 50*b* is released. As a result, because counterclockwise rotation of the cutter blade return gear 50 stops, rotation of the drive gear 32 in the second direction of rotation R2 also stops. As a result, the first cutter blade 21 stops moving at the retracted position 21B. When the first cutter blade 21 is in the retracted position 21B, the drive gear 32 is meshed with the front end of the rack 27*a* of the rack member 27.

The drive motor 31 then stops. More specifically, when the drive time of the drive motor 31 reaches a specific drive time after the first cutter blade 21 is set to the retracted position 21B, the drive motor 31 stops. As a result, the cutter 15 returns to the standby position shown in FIG. 5.

In the standby position shown in FIG. 5, the intermittent teeth part 43*a* of the compound gear 40 is at an angular position separated from the transfer gear 51, and not meshed with the transfer gear 51. The cutter blade return protrusion 50*b* of the cutter blade return gear 50 is at a position separated from the path of movement of the compound gear-side protrusion 44*b* of the compound gear 40, and the compound gear-side protrusion 44*b* is not in contact with the cutter blade return protrusion 50*b*. The cam follower 29*a* of the support frame 29 that supports the second cutter blade 22 is in contact with the cam 44*c* of the compound gear 40. As a result, the back frame part 62*c* of the support frame 29 is pushed down against the urging force of the coil springs 35, and the second cutter blade 22 is at the release position 22B separated from the first cutter blade 21.

When the printer 1 is in this standby position and the cover 8 is opened to the open position 8B to load a paper roll 2, for example, the platen roller 17, first cutter blade 21, rack member 27, drive gear 32, upstream transfer mechanism 41 (cutter blade return gear 50 and transfer gear 51), and coil springs 35 move with the cover 8, but when in the standby position, the intermittent teeth part 43*a* of the compound gear 40 are in a position not meshed with the transfer gear 51. As a result, the operation of opening the cover 8 is not obstructed by meshing of the transfer gear 51 with the intermittent teeth part 43*a* of the compound gear 40.

In the standby position, the intermittent teeth part 43*a* of the compound gear 40 is positioned not meshing with the transfer gear 51, and the compound gear-side protrusion 44*b* is positioned not in contact with the cutter blade return protrusion 50*b*. Therefore, when the cover 8 is closed from the open position 8B to the closed position 8A, the transfer gear 51 and the intermittent teeth part 43*a* of the compound gear 40 do not collide, and the cutter blade return protrusion 50*b* and the compound gear-side protrusion 44*b* do not collide. In addition, because the second cutter blade 22 is at the release position 22B, the knife edge 22*b* of the second cutter blade 22 is below the plane of motion 23 of the first cutter blade 21. Therefore, even when the cover 8 is at the open position 8B, the knife edge 22*b* of the second cutter blade 22 does not protrude from the main case 6, and is safe.

Operating Effect

Before the first cutter blade 21 moves from the forward position 21A to the retracted position 21B, the second cutter blade 22 moves from the contact position 22A to the release position 22B. As a result, the first cutter blade 21 and second cutter blade 22 do not slide against each other at any point on the return path of the first cutter blade 21 from the forward position 21A to the retracted position 21B. Therefore, wear and chattering between the first cutter blade 21 and second cutter blade 22 after cutting the recording paper 3 can be prevented.

In this example, the second cutter blade 22 is at the contact position 22A before the first cutter blade 21 moves from the retracted position 21B to the forward position 21A. Therefore, while the first cutter blade 21 moves from the retracted position 21B to the forward position 21A, the second cutter blade 22 can slide against the first cutter blade 21.

When the second cutter blade 22 is at the contact position 22A on the outbound path of the first cutter blade 21 moving from the retracted position 21B to the forward position 21A, the length of the outbound path between the retracted position 21B and the forward position 21A must be increased to assure a cutting period of sliding contact between the first cutter blade 21 and the second cutter blade 22. There is no need to increase the length of the outbound path of the first cutter blade 21 in this embodiment of the invention, however, because the second cutter blade 22 is set to the contact position 22A before the first cutter blade 21 moves from the retracted position 21B. Increasing the size of the device (printer) can therefore be prevented. Furthermore, if the second cutter blade 22 is set to the contact position 22A on the outbound path of the first cutter blade 21 moving from the retracted position 21B to the forward position 21A, the cutting period is shortened and the recording paper 3 cannot be desirably cut if the timing when the second cutter blade 22 goes to the contact position 22A is off. In this example, however, the second cutter blade 22 is set to the contact position 22A before the first cutter blade 21 moves from the retracted position 21B. As a result, the length of the cutting period can be kept constant, and the recording paper 3 can be desirably cut.

Wear of the first cutter blade 21 and second cutter blade 22 is suppressed in the cutter 15 according to this embodiment of the invention. The life of the cutter 15 can therefore be increased and the service life of the printer 1 can be extended. Noise from the two cutters 21, 22 sliding against each other in the cutter 15 can also be suppressed. Noise from the printer 1 can therefore also be suppressed.

OTHER EMBODIMENTS

The drive gear 32 may also function as the transfer gear 51. More specifically, the intermittent teeth part 43*a* of the compound gear 40 may be meshed with the drive gear 32. This enables eliminating the transfer gear 51 and reducing the number of parts.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

What is claimed is:

1. A cutter comprising:

a first cutter blade;

a second cutter blade that cuts sheet media in conjunction with the first cutter blade;

a first cutter blade moving mechanism that reciprocally moves the first cutter blade linearly within a plane of motion between a forward position where the media is cut and a retracted position different from the forward position; and a second cutter blade moving mechanism that moves the second cutter blade between a contact position where the second cutter blade contacts the first cutter blade where the media is cut, and a release position different from the contact position;

wherein the first cutter blade moving mechanism includes a cam configured to contact a cam follower of the second cutter blade moving mechanism, the cam causing the second cutter blade moving mechanism to move the second cutter blade from the contact position to the release position prior to the first cutter blade moving mechanism moving the first cutter blade from the forward position to the retracted position.

2. The cutter described in claim 1, wherein:

the cam further causes the second cutter blade moving mechanism to move the second cutter blade to the contact position prior to first cutter blade moving mechanism moving the first cutter blade from the retracted position to the forward position.

3. The cutter described in claim 2, wherein:

the second cutter blade moving mechanism includes:

a support member that supports the second cutter blade rockably on a predetermined axis of rotation to provide angular back-and-forth motion of the support member about the predetermined axis of rotation without rotating, the cam follower being on the support member; and, an urging member that applies an urging force onto the support member to bring the cam follower into contact with the cam; and wherein:

the cam rotates in conjunction with linear movement of the first cutter blade; and the support member moves the second cutter blade from the release position to the contact position by the urging member moving the support member when rotation of the cam causes the cam to not move the cam follower.

4. The cutter described in claim 1, wherein:

the second cutter blade moving mechanism includes:

a support member that supports the second cutter blade rockably on a predetermined axis of rotation to provide angular back-and-forth motion of the support member about the predetermined axis of rotation without rotating, the cam follower being on the support member; and an urging member that applies an urging force onto the support member to bring the cam follower into contact with the cam; and wherein:

the cam rotates in conjunction with linear movement of the first cutter blade; and the support member moves the second cutter blade from the contact position to the release position by rotation of the cam when the cam is urged into contact with the cam follower of the support member by the urging member.

5. The cutter descried in claim 4, wherein:

the second cutter blade is positioned toward one end of the support member;

the cam follower is positioned toward a second end of the support member opposite the first end; and the predetermined axis of rotation is positioned between the second cutter blade and the cam follower to provide a pivot point for the support member.

6. The cutter descried in claim 5, wherein the urging member applies said urging force at a position proximate to the second cutter blade, said urging force urging said second cutter blade away from said contact position.

7. A printer comprising:

the cutter described in claim 1;

a printhead;

and a conveyance mechanism that conveys sheet media through a conveyance path passing the printing position of the printhead and the cutting position of the cutter.

8. The cutter described in claim 1, wherein the released position is a fixed position.

9. The cutter described in claim 1, wherein the second cutter blade is maintained in the release position by the cam follower being in contact with the cam.

10. The cutter described in claim 9, wherein the second cutter blade is maintained in the contact position when the cam follower is not in contact with the cam.

11. The cutter described in claim 1, further including a drive motor, wherein:

the first cutter blade moving mechanism includes an intermittent gear to which rotation from the drive motor is transferred, rotation of said intermitting gear controlling movement of said first cutter blade, and the intermittent gear having said cam.

12. The cutter descried in claim 11, wherein the cam overlaps all teeth of the intermittent gear as viewed from a direction parallel to an axis of rotation of the intermittent gear.

* * * * *